US007621782B1

(12) United States Patent
Chen et al.

(10) Patent No.: US 7,621,782 B1
(45) Date of Patent: Nov. 24, 2009

(54) CONNECTOR AND LIGHT SOURCE APPARATUS

(75) Inventors: Yi-Hung Chen, Taipei (TW); Yu-Ju Liu, Taipei (TW); Chien-Chang Pei, Taipei (TW)

(73) Assignee: Everlight Electronics Co., Ltd., Taipei (TW)

( * ) Notice: Subject to any disclaimer, the term of this patent is extended or adjusted under 35 U.S.C. 154(b) by 0 days.

(21) Appl. No.: 12/368,974

(22) Filed: Feb. 10, 2009

(30) Foreign Application Priority Data

Nov. 4, 2008 (TW) ..... 97142572 A

(51) Int. Cl.
*H01R 33/00* (2006.01)

(52) U.S. Cl. ..... 439/619

(58) Field of Classification Search ..... 439/619, 439/699.1

See application file for complete search history.

(56) References Cited

U.S. PATENT DOCUMENTS 4,631,377 A * 12/1986 Imazeki et al. ..... 200/313
7,322,828 B1 * 1/2008 Chiang et al. ..... 439/56
7,527,531 B2 * 5/2009 Lin ..... 439/699.2

* cited by examiner

*Primary Examiner*—Gary F. Paumen
(74) *Attorney, Agent, or Firm*—Jianq Chyun IP Office

(57) ABSTRACT

A connector including an insulating base, two electrode rods, and two L-shaped electrode sheets is provided. The insulating base has a first side surface, a second side surface, a bottom surface connecting the first side surface and the second side surface, and two through holes. The two through holes pass through the insulating base and extend from the first side surface to the second side surface. The two electrode rods penetrate the two through holes, respectively. Each electrode rod has a first end and a second end, and the first end protrudes from the first side surface. Each L-shaped electrode sheet includes a bottom portion disposed on the bottom surface and a connection portion connected to the bottom portion. The connection portions are disposed on the second side surface and connected to the second ends of the two electrode rods, respectively. A light source apparatus is also provided.

18 Claims, 5 Drawing Sheets

CONNECTOR AND LIGHT SOURCE APPARATUS

CROSS-REFERENCE TO RELATED APPLICATION

This application claims the priority benefit of Taiwan application serial no. 97142572, filed on Nov. 4, 2008. The entirety of the above-mentioned patent application is hereby incorporated by reference herein and made a part of specification.

BACKGROUND OF THE INVENTION

1. Field of the Invention

The present invention generally relates to a connector and a light source, in particular, to a connector for electrical connection and a light source apparatus using the same.

2. Description of Related Art

With the progress in semiconductor technology, the power attained by a light-emitting diode (LED) becomes increasingly larger, and the intensity of the light emitted is getting even higher. Further, due to its advantages in being power saving, environment-friendly, and durable with a rapid response and a small volume, the LED is widely applied in products such as illuminating apparatus, traffic signals, displays, and optical mice, and is on its way to replace the conventional fluorescent lamp.

In a conventional art, fixtures are adopted for fixing an LED tube onto the lamp holder of a conventional fluorescent lamp. However, as the fixtures are not conductive and may only be used to fix the tube, additional wires are required for electrically connecting the circuit board in the tube with the lamp holder. The additional wires have to be manually welded to the circuit board in the tube and the lamp holder, so that it is difficult to assemble/disassemble the LED tube, and the replacement of the tube is troublesome and time-consuming.

In order to solve the above problem of difficulty in assembling/disassembling the LED tube, the two electrode rods of the conventional fluorescent lamp adapted for insertion into the jack of the lamp holder are directly welded to the circuit board. However, the above manner may result in other problems such as the structural strength is insufficient and the two electrode rods are lacking in parallelism. In particular, similar to the assembly of the conventional fluorescent lamp, when the electrode rods of the LED tube are inserted in the jack of the lamp holder and the LED tube is turned to a fixed position, the torque force for turning the tube may easily damage the welding points between the electrode rods and the circuit board, and lead to a detachment of the electrode rods from the circuit board. Besides, it is rather difficult to maintain the parallelism of the two electrode rods in welding, and such design may cause a low yield.

SUMMARY OF THE INVENTION

Accordingly, the present invention is directed to a connector with a high manufacturing yield.

The present invention is also directed to a light source apparatus with higher reliability.

In an embodiment of the present invention, a connector including an insulating base, two electrode rods, and two L-shaped electrode sheets is provided. The insulating base has a first side surface, a second side surface opposite to the first side surface, a bottom surface connecting the first side surface and the second side surface, and two through holes. The two through holes pass through the insulating base and extend from the first side surface to the second side surface. The two electrode rods penetrate the two through holes, respectively. Each electrode rod has a first end and a second end opposite to the first end, and the first end protrudes from the first side surface. Each L-shaped electrode sheet includes a bottom portion disposed on the bottom surface and a connection portion connected to the bottom portion. The connection portions are disposed on the second side surface and connected to the second ends of the two electrode rods, respectively.

In an embodiment of the present invention, the second ends of the electrode rods are riveted to the connection portions of the L-shaped electrode sheets, respectively.

In an embodiment of the present invention, the second ends of the electrode rods penetrate the connection portions so as to be riveted to the connection portions, respectively.

In an embodiment of the present invention, each L-shaped electrode sheet has a pin located below the bottom surface and protruding in a direction away from the bottom surface.

In an embodiment of the present invention, the first side surface has two recesses respectively in communication with the two through holes. Each electrode rod has a flange between the first end and the second end, and the flanges of the electrode rods are respectively embedded in the recesses.

In an embodiment of the present invention, the inner diameters of the recesses are larger than those of the through holes.

In an embodiment of the present invention, the electrode rods are substantially parallel to each other.

In another embodiment of the present invention, a light source apparatus including a carrier board, at least one light-emitting element, and the above connector is also provided. The light-emitting element is disposed on the carrier board. The connector is disposed on the carrier board and electrically connected to the light-emitting element. The bottom portions of the L-shaped electrode sheets of the connector are connected to the carrier board.

In an embodiment of the present invention, the connection portions are mounted to the carrier board.

In an embodiment of the present invention, the carrier board is a circuit board.

In an embodiment of the present invention, the pin of each L-shaped electrode sheet penetrates the carrier board.

In an embodiment of the present invention, the light-emitting element is a light-emitting diode (LED).

In an embodiment of the present invention, the at least one light-emitting element is a plurality of light-emitting elements arranged along a straight reference line.

In the connector according to the embodiment of the present invention, as the electrode rods are inserted in the through holes of the insulating base and the joint area between the bottom portions of the L-shaped electrode sheets and the carrier board is large, the insulating base is able to support the electrode rods against external forces, and the bottom portions of the L-shaped electrode sheets are stably joined to the carrier board without being easily detached. Therefore, the light source apparatus is highly reliable.

Moreover, as the two electrode rods of the connector according to the embodiment of the present invention are inserted in the two through holes of the insulating base, a high parallelism is easily maintained between the electrode rods during assembly simply by making the two through holes parallel to each other in the manufacturing of the insulating base. Thus, the connector according to an embodiment of the present invention achieves a high manufacturing yield, and the manufacturing yield and quality of the light source apparatus are further improved.

In order to make the aforementioned and other objectives, features, and advantages of the present invention comprehensible, embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
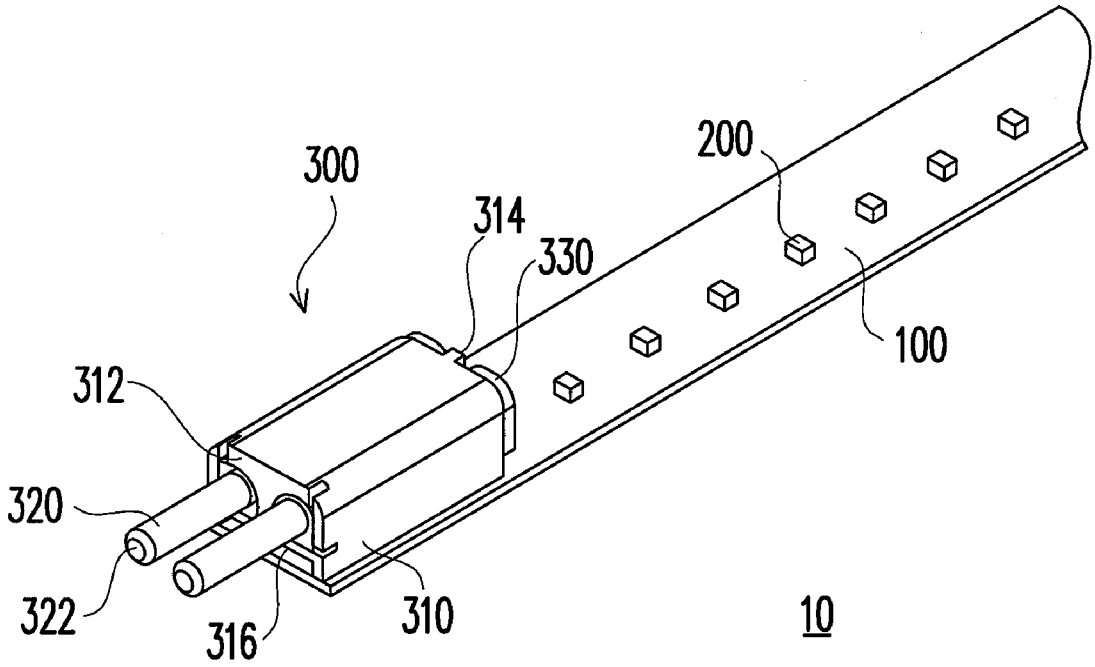
FIG. 1 is a schematic view of a light source apparatus according to an embodiment of the present invention.

Reference will now be made in detail to the present embodiments of the invention, examples of which are illustrated in the accompanying drawings. Wherever possible, the same reference numbers are used in the drawings and the description to refer to the same or like parts.

Figure 2:
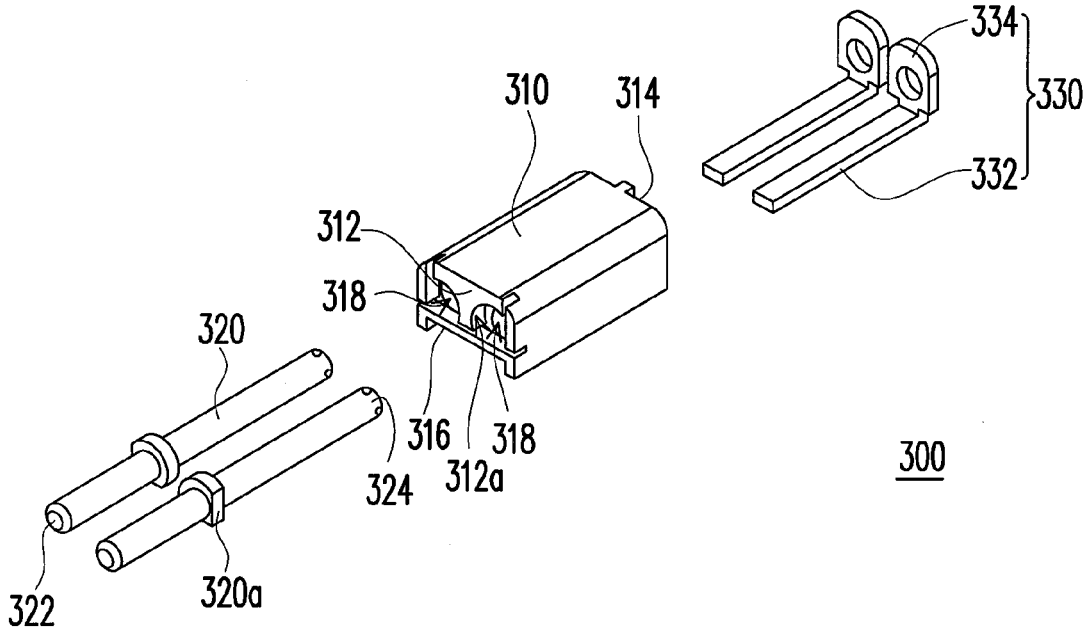
FIG. 2 is an exploded view of a connector in the light source apparatus in FIG. 1.

FIG. 1 is a schematic view of a light source apparatus according to an embodiment of the present invention. FIG. 2 is an exploded view of a connector in the light source apparatus in FIG. 1. Referring to FIGS. 1 and 2, the light source apparatus 10 includes a carrier board 100, a plurality of light-emitting elements 200, and a connector 300. The light-emitting elements 200 and the connector 300 electrically connected to each other are all disposed on the carrier board 100. In this embodiment, the carrier board 100 is, for example, a circuit board, and the light-emitting elements 200 are, for example, LEDs. Further, the light-emitting elements 200 are arranged along a straight reference line on the circuit board. The connector 300 includes an insulating base 310, two electrode rods 320, and two L-shaped electrode sheets 330. The insulating base 310 has a first side surface 312, a second side surface 314, a bottom surface 316, and two through holes 318. The second side surface 314 is disposed opposite to the first side surface 312, and the bottom surface 316 connects the first side surface 312 and the second side surface 314.

Specifically, the two through holes 318 of the insulating base 310 penetrate the insulating base 310 and extend from the first side surface 312 to the second side surface 314. The two electrode rods 320 respectively penetrate the two through holes 318, and a first end 322 of each electrode rod 320 protrudes from the first side surface 312 so as to be inserted in the jack of the lamp holder (not shown) for forming an electrical connection with the lamp holder. In this embodiment, the specification of the lamp holder is, for example, G5. However, in other embodiments, the electrode rod 320 may also be designed in accordance with the specifications of other lamp holders. Moreover, in this embodiment, the electrode rod 320 is in the shape of a cylinder. However, in other embodiments, the electrode rod may also be in the shape of a quadrangular prism or other shapes of rods.

Each of the L-shaped electrode sheets 330 includes a bottom portion 332 and a connection portion 334. The bottom portion 332 is disposed on the bottom surface 316 of the insulating base 310 and connected to the carrier board 100. The connection portion 334 is connected to the bottom portion 332. In this embodiment, the bottom portion 332 is, for example, welded to the carrier board 100, such that the connector 300 can be firmly fixed to the carrier board 100. Here, the bottom portion 332 may be welded to the carrier board 100 through the surface mount technology (SMT). The connection portions 334 are disposed on the second side surface 314 and connected to the second ends 324 of the electrode rods 320, respectively. In other words, the L-shaped electrode sheets 330 are connected between the carrier board 100 and the electrode rods 320. Therefore, the electrode rods 320 are electrically connected to the carrier board 100 through the L-shaped electrode sheets 330.

In this embodiment, the first side surface 312 of the connector 300 has two recesses 312*a* respectively in communication with the two through holes 318. More specifically, the inner diameters of the through holes 318 are suitable for receiving the electrode rods 320, and the inner diameters of the recesses 312*a* are larger than those of the through holes 318. Moreover, each of the electrode rods 320 may further have a flange 320*a* located between the first end 322 and the second end 324. When assembled, the flanges 320*a* of the electrode rods 320 are respectively embedded in the recesses 312*a* so as to fix the electrode rods 320 in the insulating base 310 of the connector 300.

Figure 3A:
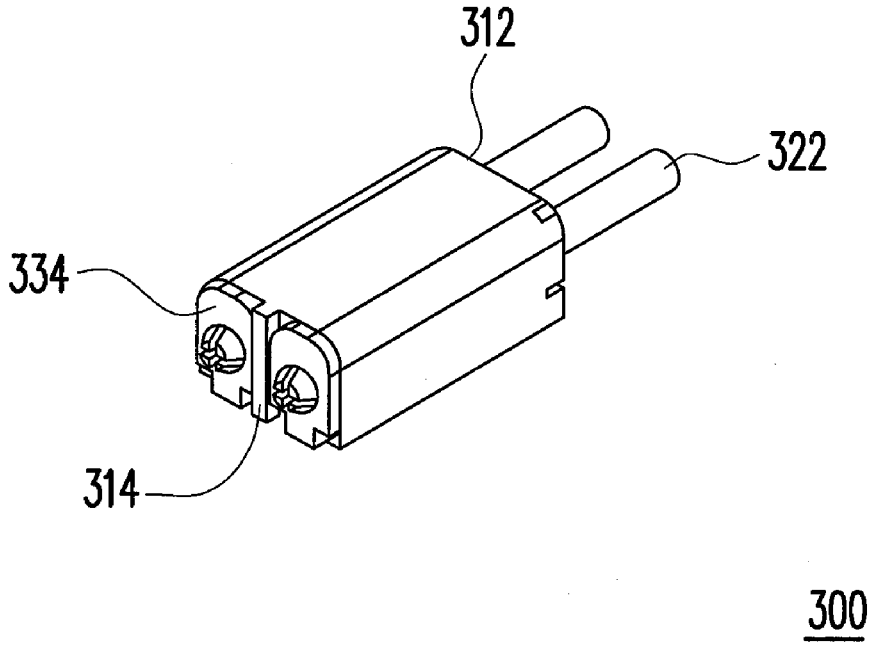
FIG. 3A is a schematic view of a connector according to an embodiment of the present invention.
Figure 3B:
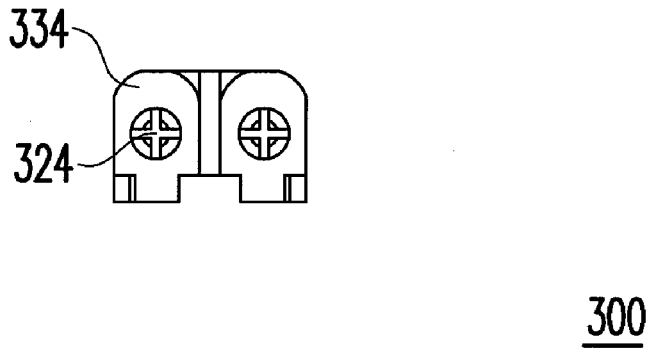
FIG. 3B is a schematic view of the connector in FIG. 3A from another viewing angle.

FIG. 3A is a three-dimensional view of the connector in FIG. 1, and FIG. 3B is a side view of the connector in FIG. 1. Referring to FIGS. 2, 3A, and 3B, in this embodiment, the second ends 324 of the electrode rods 320 are riveted to the connection portions 334 of the L-shaped electrode sheets 330. Specifically, the second ends 324 of the electrode rods 320 respectively penetrate the connection portions 334 so as to be riveted to the connection portions 334.

Figure 4:
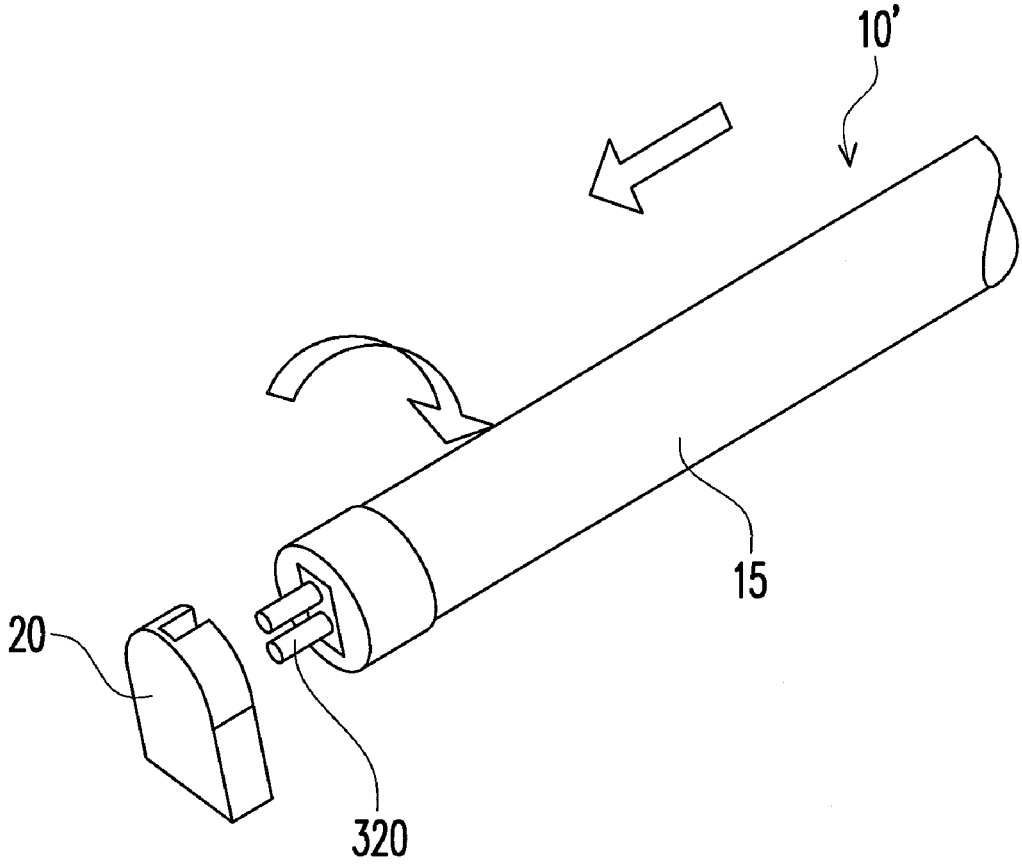
FIG. 4 is a schematic view of a light source apparatus assembled to a lamp holder according to an embodiment of the present invention.

FIG. 4 is a schematic view of a light source apparatus assembled to a lamp holder according to another embodiment of the present invention. Referring to FIGS. 1, 2, and 4, compared with the above light source apparatus 10, the light source apparatus 10' of this embodiment further includes a light transmissive lamp cover 15 enclosing the circuit board 100 and the light-emitting elements 200. When the light source apparatus 10' is assembled to the lamp holder 20, the electrode rods 320 of the connector 300 must first be inserted in the lamp holder 20, and the light source apparatus 10' is then turned by an angle to a fixed position, such that the electrode rods 320 are communicated with an external power source. As the electrode rods 320 in this embodiment are inserted in the through holes 318 of the insulating base 310 and the joint area between the bottom portions 332 of the L-shaped electrode sheets 330 and the carrier board 100 is large, when the light source apparatus 10' is turned, the insulating base 310 supports the electrode rods 320 against external forces, and the bottom portions 332 are stably joined to the carrier board 100 without being easily detached. Therefore, the light source apparatus 10 and the light source apparatus 10' are highly reliable.

Further, as the two electrode rods 320 of the connector 300 in this embodiment are inserted in the two through holes 318 of the insulating base 310, a high parallelism is easily maintained between the electrode rods 320 during assembly simply by making the two through holes 318 parallel to each other in the manufacturing of the insulating base 310. Thus, the connector 300 of this embodiment achieves a high manufacturing yield.

Figure 5:
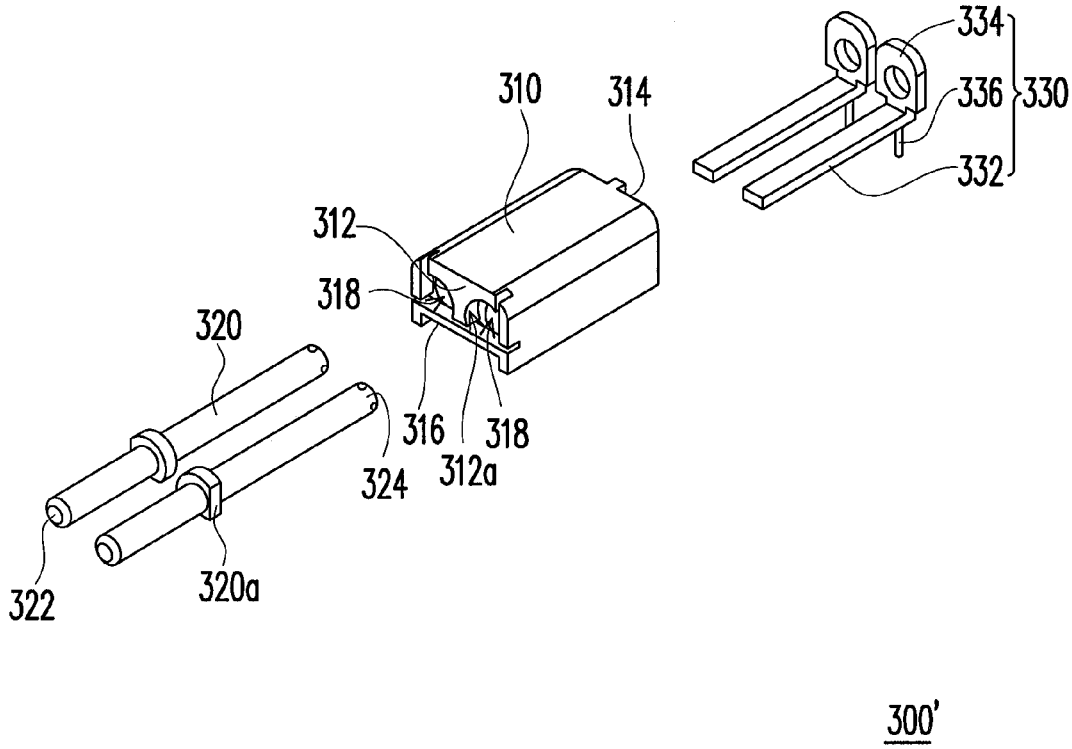
FIG. 5 is an exploded view of a connector according to another embodiment of the present invention.

FIG. 5 is an exploded view of a connector according to another embodiment of the present invention. Referring to FIG. 5, a connector 300' of this embodiment is similar to the aforementioned connector 300 in FIG. 2 except for the following differences. In the connector 300', each of the L-shaped electrode sheets 330 further has a pin 336 located below the bottom surface 316 and protruding in a direction away from the bottom surface 316. The pin 336 is joined to the carrier board by first penetrating the bored carrier board 100 and then being welded to the carrier board 100. In this manner, the L-shaped electrode sheets 330 are more stably joined to the carrier board 100.

In view of the above, in the connector according to the embodiments of the present invention, as the electrode rods are inserted in the through holes of the insulating base and the joint area between the bottom portions of the L-shaped electrode sheets and the carrier board is large, the insulating base is able to support the electrode rods against external forces, and the bottom portions of the L-shaped electrode sheets are stably joined to the carrier board without being easily detached. Therefore, the light source apparatus is highly reliable.

Moreover, as the two electrode rods of the connector according to an embodiment of the present invention are inserted in the two through holes of the insulating base, a high parallelism is easily maintained between the electrode rods during assembly simply by making the two through holes parallel to each other in the manufacturing of the insulating base. Thus, the connector according to an embodiment of the present invention achieves a high manufacturing yield, and the manufacturing yield and quality of the light source apparatus are further improved.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A connector, comprising:

an insulating base, having:

a first side surface;

a second side surface, opposite to the first side surface;

a bottom surface, connecting the first side surface and the second side surface; and two through holes, passing through the insulating base and extending from the first side surface to the second side surface;

two electrode rods, respectively penetrating the two through holes, wherein each of the electrode rods comprises a first end and a second end opposite to the first end, and the first end protrudes from the first side surface; and two L-shaped electrode sheets, each comprising:

a bottom portion, disposed on the bottom surface; and a connection portion, connected to the bottom portion and disposed on the second side surface, wherein the connection portions of the L-shaped electrode sheets are connected to the second ends of the electrode rods, respectively.

2. The connector according to claim 1, wherein the second ends of the electrode rods are riveted to the connection portions of the L-shaped electrode sheets, respectively.

3. The connector according to claim 2, wherein the second ends of the electrode rods penetrate the connection portions so as to be riveted to the connection portions, respectively.

4. The connector according to claim 1, wherein each of the L-shaped electrode sheets comprises a pin located below the bottom surface and protruding in a direction away from the bottom surface.

5. The connector according to claim 1, wherein the first side surface comprises two recesses respectively in communication with the two through holes, each of the electrode rods comprises a flange located between the first end and the second end, and the flanges of the electrode rods are respectively embedded in the recesses.

6. The connector according to claim 5, wherein the inner diameters of the recesses are larger than those of the through holes.

7. The connector according to claim 1, wherein the electrode rods are substantially parallel to each other.

8. A light source apparatus, comprising:

a carrier board;

at least one light-emitting element, disposed on the carrier board; and a connector, disposed on the carrier board and electrically connected to the light-emitting element, the connector comprising:

an insulating base, having:

a first side surface;

a second side surface, opposite to the first side surface;

a bottom surface, connecting the first side surface and the second side surface; and two through holes, passing through the insulating base and extending from the first side surface to the second side surface;

two electrode rods, respectively penetrating the two through holes, wherein each of the electrode rods comprises a first end and a second end opposite to the first end, and the first end protrudes from the first side surface; and two L-shaped electrode sheets, each comprising:

a bottom portion, disposed on the bottom surface and connected to the carrier board; and a connection portion, connected to the bottom portion and disposed on the second side surface, wherein the connection portions of the L-shaped electrode sheets are connected to the second ends of the electrode rods, respectively.

9. The light source apparatus according to claim 8, wherein the second ends of the electrode rods are riveted to the connection portions of the L-shaped electrode sheets, respectively.

10. The light source apparatus according to claim 9, wherein the second ends of the electrode rods penetrate the connection portions so as to be riveted to the connection portions, respectively.

11. The light source apparatus according to claim 8, wherein the connection portions are mounted to the carrier board.

12. The light source apparatus according to claim 8, wherein the carrier board is a circuit board.

13. The light source apparatus according to claim 8, wherein each of the L-shaped electrode sheets comprises a pin located below the bottom surface, protruding in a direction away from the bottom surface, and penetrating the carrier board.

14. The light source apparatus according to claim 8, wherein the light-emitting element is a light-emitting diode (LED).

15. The light source apparatus according to claim 8, wherein the at least one light-emitting element is a plurality of light-emitting elements arranged along a straight reference line.

16. The light source apparatus according to claim 8, wherein the first side surface comprises two recesses respectively in communication with the two through holes, each of the electrode rods comprises a flange located between the first end and the second end, and the flanges of the electrode rods are respectively embedded in the recesses.

17. The light source apparatus according to claim 16, wherein the inner diameters of the recesses are larger than those of the through holes.

18. The light source apparatus according to claim 8, wherein the electrode rods are substantially parallel to each other.

* * * * *